US006684860B2

(12) United States Patent
Baessler et al.

(10) Patent No.: US 6,684,860 B2
(45) Date of Patent: Feb. 3, 2004

(54) CLAMPING ELEMENT FOR A FUEL INJECTION VALVE AND FUEL INJECTION SYSTEM

(75) Inventors: Albrecht Baessler, Korntal-Muenchingen (DE); Thomas Fuerst, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,165

(22) PCT Filed: Aug. 25, 2001

(86) PCT No.: PCT/DE01/03260

§ 371 (c)(1),
(2), (4) Date: Aug. 29, 2002

(87) PCT Pub. No.: WO02/18777

PCT Pub. Date: Mar. 7, 2002

(65) Prior Publication Data

US 2003/0101969 A1 Jun. 5, 2003

(30) Foreign Application Priority Data

Sep. 1, 2000 (DE) ..... 100 34 084

(51) Int. Cl.[7] ..... F02M 37/04
(52) U.S. Cl. ..... 123/470; 123/509
(58) Field of Search ..... 123/470, 509, 123/468, 456, 469; 239/600

(56) References Cited

U.S. PATENT DOCUMENTS

| | | | | | |
|---|---|---|---|---|---|
| 5,121,731 | A | * | 6/1992 | Jones | 123/470 |
| 5,140,963 | A | * | 8/1992 | Brackett et al. | 123/470 |
| 5,970,953 | A | * | 10/1999 | Lorraine et al. | 123/470 |
| 6,148,797 | A | * | 11/2000 | Gmelin | 123/456 |
| 6,186,123 | B1 | * | 2/2001 | Maier et al. | 123/470 |
| 6,318,341 | B1 | * | 11/2001 | Gmelin et al. | 123/470 |

FOREIGN PATENT DOCUMENTS

| | | |
|---|---|---|
| DE | 197 35 665 | 1/1999 |
| DE | 197 56 102 | 6/1999 |
| EP | 0 969 203 | 1/2000 |
| JP | 08 312503 | 11/1996 |

* cited by examiner

*Primary Examiner*—Carl S. Miller
(74) *Attorney, Agent, or Firm*—Kenyon & Kenyon

(57) ABSTRACT

A clamping element for a fuel injector is provided that is insertable into a mounting hole of a cylinder head of an internal combustion engine, and that directly injects fuel into a combustion chamber of the internal combustion engine has a first step ring. This at least partially surrounds the fuel injector and has a valve pressure surface that may rest on the fuel injector. The first step ring has at least one circumferential slope surface on its side facing away from the valve pressure surface, which engages with a corresponding circumferential slope surface of a second step ring, which has a counterpressure surface. The slope surfaces are arranged so that the first step ring and the second step ring are pressed axially apart when they are rotated relatively to one another.

11 Claims, 3 Drawing Sheets

Fig. 1
PRIOR ART
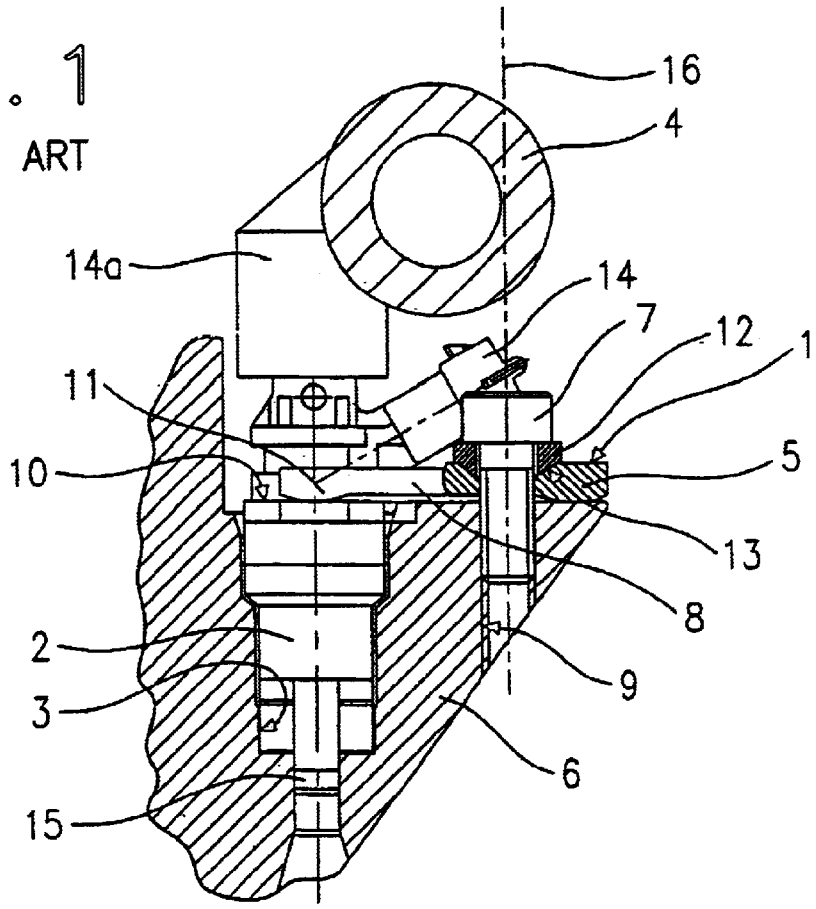
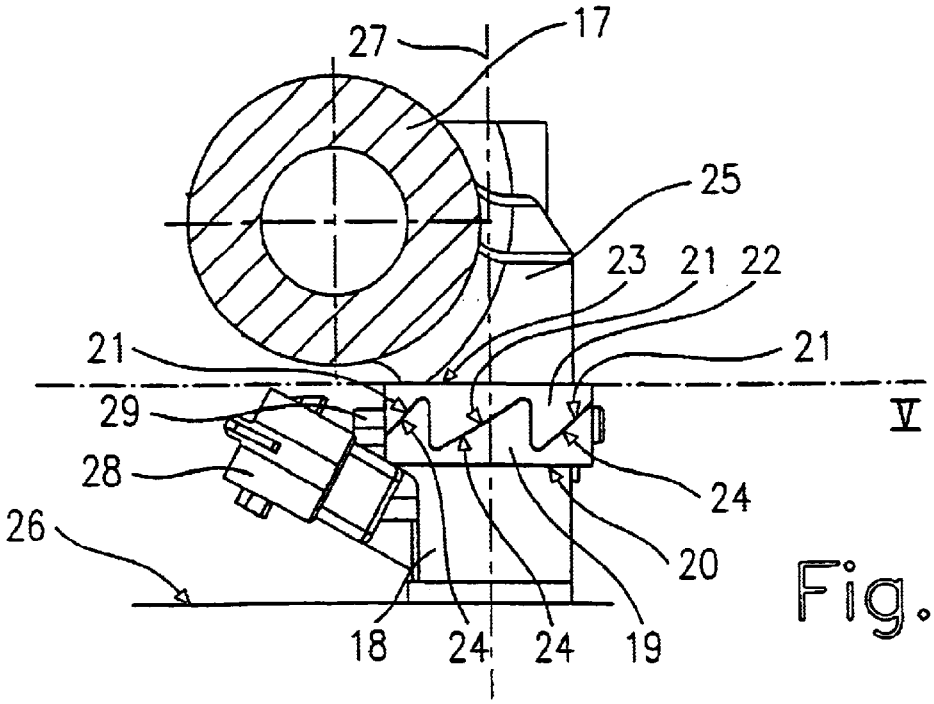
Fig. 2

CLAMPING ELEMENT FOR A FUEL INJECTION VALVE AND FUEL INJECTION SYSTEM

FIELD OF THE INVENTION

The present invention relates to a clamping element and a fuel injection system.

BACKGROUND INFORMATION

A clamping element in the form of a hold-down element is referred to in Japanese Published Patent Application No. 08-312503. The hold-down element holds down a fuel injector against a relatively high combustion pressure prevailing in the combustion chamber of the internal combustion engine. The hold-down element engages with a collar of the fuel injector at two circumferentially opposite locations, the collar resting with its lower side on the upper side of the cylinder head, so that the fuel injector is held down. The hold-down element is pulled on to the cylinder head by a clamping screw.

It is believed that the hold-down element referred to in Japanese Published Patent Application No. 08-312503 has the disadvantage that it is difficult to access the clamping screw if a fuel distribution line has already been fitted. If the fuel distribution line is not fitted until after the hold-down elements have been fitted and after they have been pre-tensioned to the defined retention force, the fuel injectors may no longer be moved or may only be moved if considerable force is applied, and tolerances at the connection points to the fuel distribution line, which in the case of high-pressure injection systems is rigid, may not be modified. Furthermore, a tight connection may only be achieved with difficulty or not at all. If the clamping screws are not tightened until after the fuel distribution line has been fitted, it may be difficult to access the clamping screws.

Furthermore, a hold-down device embodied as a clamp bracket similar hold-down element referred to in Japanese Published Patent Application No. 08-312503, is referred to in German Published Patent Application No. 197 35 665. In the case of the hold-down device, the cylinder head has a recess in which the collar of the fuel injector is arranged, so that the collar of the fuel injector on which the hold-down device acts is lowered into the cylinder head. It is believed that this has the disadvantages already mentioned.

A clamping element that holds a fuel injector in a mounting hole of a cylinder head of an internal combustion engine and rests against a fuel distribution line, is referred to in German Published Patent Application No. 197 56 102. The clamping element includes a spiral spring that extends between a spring holding element of the fuel injector and a spring holding element of the fuel distribution line. Furthermore, from German Published Patent Application No. 197 56 102, for assembly, one or more assembly clamps, which pre-tension the fuel injector, the fuel distribution line and the spiral springs and hold them in their position until assembly has been completed, should be provided.

It is believed that a disadvantage of the clamping element referred to in German Published Patent Application No. 197 56 102 is that with a spiral spring it may be difficult to achieve the necessary high clamping forces. Furthermore, it may be disadvantageous that, if a pre-mounted unit that includes a fuel distribution line, clamping elements and fuel injectors is fitted, additional assembly clamps may be required. Moreover, it may be disadvantageous that, when the fuel distribution line is fitted all spiral springs should be tensioned simultaneously and adjustments of individual fuel injectors to any tolerances in the mounting hole in question may not be carried out consecutively.

SUMMARY OF THE INVENTION

By contrast, it is believed that an exemplary clamping element according to the present invention has the advantage that high clamping forces may be achieved using small clamping element dimensions.

It is believed to be advantageous if the first step ring and the second step ring have coaxial holes into which the fuel injector and a connection piece of a fuel distribution line may be inserted. Thus, small design dimensions and a favorable arrangement of the clamping element may be achieved because only one circumferential collar around the fuel injector is required to bear the clamping force. Furthermore, it is believed to be advantageous that the clamping element may be held in the holes.

It is believed to be advantageous if the first step ring and the second step ring are held so that they are concentric relative to one another by shoulder of the first step ring or second step ring that engages with a corresponding step of an axial hole of the other step ring. As a result, the clamping element may be a compact, self-contained component, which may be inserted as a single element during assembly.

It is believed to be advantageous if the first step ring and the second step ring each have on their circumference a bolt that is rotatably mounted axially parallel to the step ring and is axially movable, and have a hole that extends across it, and if the hole of one bolt is a threaded hole, and if a screw that is held in the hole of the other bolt is present and engages with the threaded hole. Thus, the first and second step ring may be rotated against one another and the clamping force of the clamping element may be adjusted. For example, the screw may be arranged so that it is easily accessible, as the axis of the screw points away from a plane that is at least approximately formed by the fuel injectors and the fuel distribution line and does not lie in that plane.

It is believed that an exemplary fuel injection system according to the present invention has the advantage relative to the related art that the retention force is imparted against the fuel distribution line. As a result, no additional components may be required, which may save space. Moreover, the sequence of tensioning may be chosen freely.

BRIEF DESCRIPTION OF THE DRAWINGS

FIG. 1 shows a clamping element via which a fuel injector is clamped into a mounting hole.

FIG. 2 shows an exemplary clamping element according to the present invention installed between a fuel distribution line and a fuel injector.

DETAILED DESCRIPTION

Figure 3:
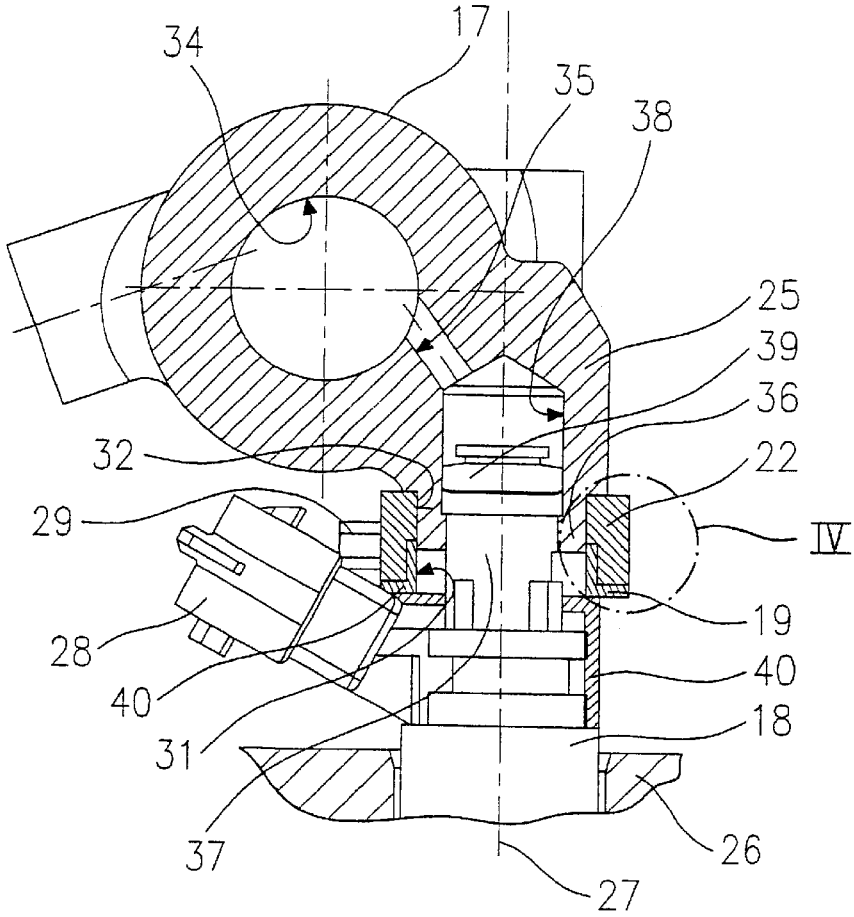
FIG. 3 is a sectional view of the exemplary clamping element according to the present invention shown in FIG. 2 with fuel a distribution line.

FIG. 1 shows a clamping element. The clamping element is in the form of a hold-down element 1, which holds a fuel injector 2 in a mounting hole 3. Fuel injector 2 is connected to a rigid fuel distribution line 4, for fuel injectors that inject fuel at high pressure into the combustion chamber. Hold-down element 2 has a contact piece 5, which rests on a cylinder head 6 (shown here in section view, and only partly shown) and has an attachment element that is embodied as screw 7. Screw 7 penetrates a lever arm 8 of hold-down element 1 and is screwed into a threaded hole 9 of cylinder head 6.

Lever arm 8 divides in the shape of a fork around fuel injector 2. Fuel injector 2 has a step 10, on whose radial surface pressure mushrooms 11, which are formed on the ends of the fork-shaped section of lever arm 8 of hold-down element 1, rest. If it is rotated deeper into threaded hole 9, screw 7 pulls lever arm 8, which rests against cylinder head 6 via contact piece 5, toward cylinder head 6 via a washer 12, which allows angle compensation via a spherical surface 13. As a result, at the fork-shaped end of lever arm 8 a clamping force is exerted on fuel injector 2 in the direction of mounting hole 3 via pressure mushrooms 11 (only one can be seen in the chosen view in the drawing) at two points of step 10 that are located opposite one another on the circumference of fuel injector 2. This clamping force holds fuel injector 2 in mounting hole 3 against the combustion pressure in the combustion chamber (not shown).

FIG. 1 also shows connector plug 14 for triggering fuel injector 2 and seal 15 opposite the combustion chamber. Fuel distribution line 4 is connected to fuel injector 2 via connector nozzle 14*a*.

There may be little space, for example, next to and above the cylinder head, since it is desirable for the design of the internal combustion engine to be compact. As a result, fuel distribution line 4 is arranged as directly as possible above fuel injectors 2 and is generally offset somewhat from the middle of the cylinder head. This results in the arrangement shown in FIG. 1, in which the extension of central axis 16 of screw 7 intersects with fuel distribution line 4. As a result, once fuel distribution line 4 has been installed, a tool may be only introduced laterally and with freedom of movement in one plane. This may be hindered by other components, such as, for example, the ignition or gas exchange system.

FIG. 2 shows an exemplary clamping element according to the present invention that is arranged between a fuel distribution line 17 (only partly shown) and a fuel injector 18 (only partly shown), which is inserted into a cylinder head 26. A first step ring 19 has a valve pressure surface 20, which rests indirectly against fuel injector 18. On the side facing away from fuel injector 18 and valve pressure surface 20, first step ring 19 has a plurality of circumferential slope surfaces 21, which are arranged in one direction circumferentially, have the same incline, and each form a section of a screw surface.

A second step ring 22 has a counterpressure surface 23, which rests against a shoulder of fuel distribution line 17. On the side facing fuel injector 18, second step ring 22 also has a plurality of circumferential slope surfaces.

Counterpressure surface 23 rests against a connection piece 25 of fuel distribution line 17. Furthermore, a central axis 27, which corresponds to the axis of the mounting hole (not shown) of fuel injector 18 in cylinder head 26, is also shown in the drawing. Circumferential slope surfaces 21, 24 of first step ring 19 and of second step ring 22 match one another in their incline and orientation of rotation so that they work together as a thread and, respectively, engage with one another via their slope surfaces 21, 24. Incline surfaces 21, 24 may, for example, resemble the teeth of a saw.

FIG. 2 also shows a connector plug 28 of fuel injector 18, which in the embodiment shown in FIG. 2 is a fuel injector 18 having an electrically triggered actuator. Furthermore, FIG. 2 shows parts of a tensioning device 29 (largely hidden) which allows first step ring 19 and second step ring 22 to be rotated relative to one another and which is described in detail with respect to FIG. 5 below.

In the non-tensioned state shown in FIG. 2, individual circumferential slope surfaces 21 of first step ring 19 are in contact with the corresponding circumferential slope surfaces of second step ring 22 so that every circumferential slope surface 21, 24 is in contact with a corresponding circumferential slope surface 21, 24 over its entire surface. If first step ring 19 and second step ring 22 are rotated relative to one another, circumferential slope surfaces 21, 24 slide against each other and push first step ring 19 and second step ring 22 apart. Valve pressure surface 20 and counterpressure surface 23 move in the axial direction relative to central axis 27.

If valve pressure surface 20 rests on fuel injector 18 and counterpressure surface 23 rests on connection piece 25 of fuel distribution line 17, the clamping element presses fuel injector 18 into mounting hole of cylinder head 26, and rests against fuel distribution line 17. If the incline of the circumferential slope surfaces 21, 24 is appropriately chosen, the compressive force exerted may be determined as a function of the force with which first step ring 19 and second step ring 22 are rotated relative to one another. In particular, substantial compressive forces may be achieved.

The maximum distance in the axial direction relative to central axis 27 by which first step ring 19 and second step ring 22 may be pressed apart may be determined by the number of circumferential slope surfaces 21, 24 and the incline. Thus, substantial tolerances may be offset in the axial direction relative to central axis 27 that arise between fuel distribution line 17 and fuel injector 18. Furthermore, the clamping element does not require any further attachment point on cylinder head 26, like screw 7 in FIG. 1 in the case of a hold-down element. Altogether, the dimensions of an exemplary clamping element according to the present invention may be small.

FIG. 3 shows the exemplary clamping element according to the present invention shown in FIG. 2 in a sectional view, fuel distribution line 17 being partially shown in a sectional view. In FIG. 3, the same reference numbers are used as in FIG. 2 for the same elements. Fuel injector 18, which is inserted into cylinder head 26, is also only partly shown. Connection piece 25 of fuel distribution line 17 is connected via an inflow hole 35 to a distribution pipe 34 of fuel distribution line 17. Central axis 27, which is shown in the FIG. 3, corresponds to the axis of the mounting hole (not shown) of fuel injector 18 in cylinder head 26.

Moreover, connection piece 25 has a smaller-diameter shoulder 36, which is held in a coaxial hole 31 of first step ring 19 and in a coaxial hole 32 of second step ring 22, which have the same diameter. Thus, the clamping element is defined radially relative to central axis 27 with regard to connection piece 25 of fuel distribution line 17.

Fuel injector 18 is inserted into a hole 38 of connection piece 25 of fuel distribution line 17 via an inflow section 37. A ring seal 39 seals inflow section 37 of fuel injector 18 against hole 38 of connection piece 25. Fuel injector 18 has a clamping sleeve 40 (shown in a sectional view), on which first step ring 19 rests and which has a recess, e.g., in the area of connector plug 28. This clamping sleeve 40 and fuel injector 18 may be a single component. FIG. 3 also shows connector plug 28 of fuel injector 18, which in the embodiment shown in FIG. 3, is a fuel injector 18 having an electrically triggered actuator, and also partially shows tensioning device 29, which is explained in detail with respect to FIG. 5 below.

Figure 4:
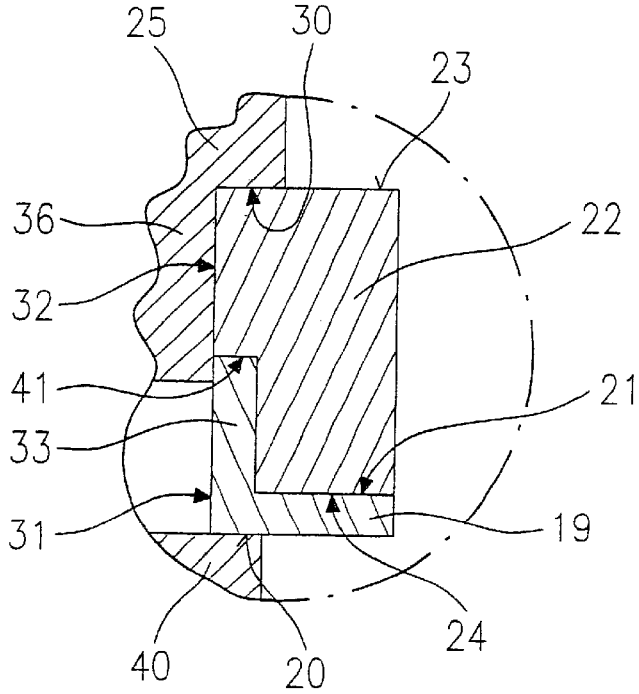
FIG. 4 is a sectional view showing further detail of portion IV shown in FIG. 3.

FIG. 4 shows detail section IV from FIG. 3. First step ring 19 rests against clamping sleeve 40 of fuel injector 18 via valve pressure surface 20. Second step ring 22 rests on a shoulder 30 of connection piece 25 of fuel distribution line 17 via counterpressure surface 23. Circumferential slope surface 21 of first step ring 19 and circumferential slope surface 24 of second step ring 22 are formed so that radially inward they do not reach coaxial hole 31 of first step ring 19 and coaxial hole 32 of second step ring 22. First step ring 19 has a shoulder 33, which is held in a step 41 of coaxial hole 32 of second step ring 22.

Fuel injector 18 and connection piece 25 of fuel distribution line 17 may be inserted into one another. The seal created by ring seal 39 may be checked when a pre-mounted unit that includes fuel injector 18, the clamping element and fuel distribution line 17 is produced because, in the non-tensioned state, the exemplary clamping element according to the present invention may not exert any force on fuel injector 18 and fuel distribution line 17, and therefore the components remain in the position relative to one another that they were in when checked. Furthermore, the exemplary clamping element according to the present invention may have small dimensions and be held by concentric holes 31, 32 and smaller-diameter shoulder 36 of connection piece 25. Moreover, shoulder 33 of first step ring 19, which is held in step 41 of coaxial hole 32 of second step ring 22, may help ensure that circumferential slope surfaces 21, 24 are unable to move radially relative to one another.

Figure 5:
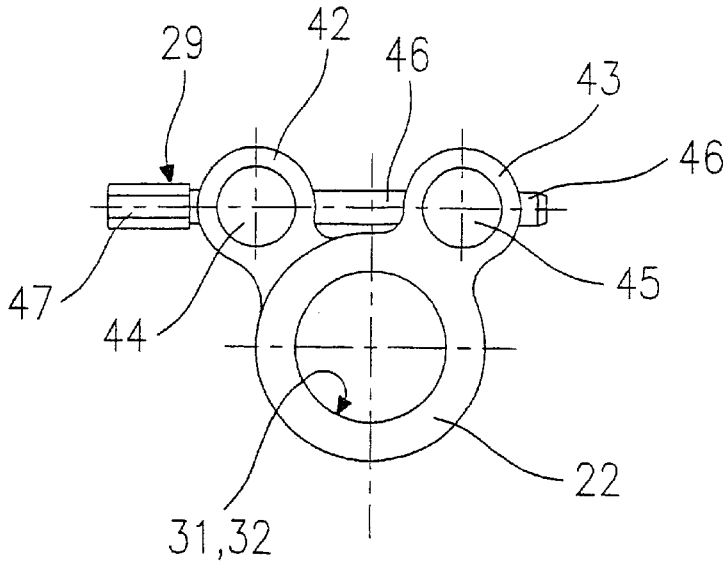
FIG. 5 is a sectional view of the exemplary clamping element of FIG. 2, with a tensioning device formed by a screw.

FIG. 5 shows a top view of second step ring 22 across section plane V of FIG. 2. The parts of fuel injector 18 and connection piece 25 of fuel injection line 17 that are located inside coaxial holes 31, 32 of first step ring 19 and of second step ring 22 are not shown. As shown in FIG. 5, first step ring 19 is hidden by second step ring 22. Tensioning device 29 includes a first double eye 42, which is attached to first step ring 19, and second double eye 43, which is attached to second step ring 22. A first bolt 44 is rotatably and axially movably mounted in first double eye. 42. Correspondingly, a second bolt 45 is rotatably and axially movably mounted in second double eye 43. Second bolt 45 has a threaded hole into which a screw 46 is inserted so that it extends transversely. Screw 46 is held in a hole of first bolt 44 and rests against first bolt 44 via a screw head 47.

If this screw is rotated into the threaded hole of second bolt 45, screw head 47 pulls second bolt 45 in the direction of first bolt 44. First step ring 19 and second step ring 22 are rotated relative to one another via first double eye 42 and second double eye 43 and the clamping element is tensioned. As first step ring 19 and second step ring 22 move apart in the direction of the axes of bolts 44, 45, there may be a tendency for screw 46 to tilt in the threaded hole of second bolt 45 and the hole of first bolt 44. To avoid this tendency, bolts 44, 45 are axially movable, and therefore may compensate for the movement apart of first step ring 19 and second step ring 22.

Figure 6:
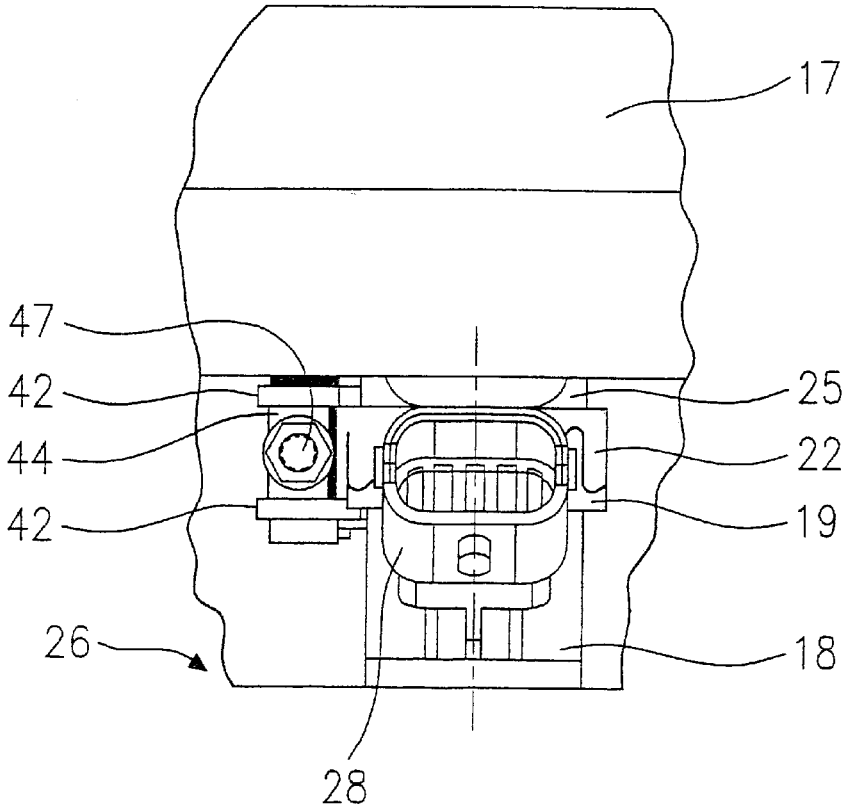
FIG. 6 shows an exemplary clamping element according to he present invention installed between a fuel distribution line and a fuel injector, shown in a side view that has been rotated by 90° relative to the exemplary embodiment shown in FIG. 2.

FIG. 6 shows a side view of an exemplary clamping element according to the present invention installed between a fuel distribution line 17 (only partly shown) and a fuel injector 18 (only partly shown) rotated by 900 relative to the side view in FIG. 2. The same reference numbers have been used for the same components.

FIG. 6 shows fuel injector 18 having connector plug 28 and cylinder head 26. First step ring 19 and second step ring 22 are located between connection piece 25 of fuel distribution line 17 and fuel injector 18. First bolt 44 is held in first double eye 42, which is connected to first step ring 19. Screw head 47 rests against this first bolt 44. First bolt 44 may be moved in the direction of its axis in first double eye 42.

Screw head 47 is easily accessible with a tool because, as shown in FIG. 6, it may be arranged so that it points away from the internal combustion engine. The screw head 47 may be easily reached, since screw head 47 is not covered by other components and is reachable with an appropriate tool.

What is claimed is:

1. A clamping arrangement for a fuel injector, which is insertable into a mounting bole of a cylinder head of an internal combustion engine to directly inject fuel into a combustion chamber of the internal combustion engine, the clamping arrangement comprising:

a first step ring at least partially surrounding the fuel injector and resting on the fuel injector via a valve pressure surface, the first step ring including at least one first circumferential slope surface on a side of the first step ring facing away from the valve pressure surface; and a second step ring including at least one second circumferential slope surface and a counterpressure surface;

wherein the at least one first circumferential slope surface of the first step ring engages with the at least one second circumferential slope surface of the second step ring, and the at least one first circumferential slope surface of the first step ring and the at least one second circumferential slope surface of the second step ring are arranged so that the first step ring and the second step ring are pressed axially apart when rotated relatively to one another.

2. The clamping arrangement of claim 1, wherein each of the first step ring and the second step ring includes coaxial holes into which the fuel injector and a connection piece of a fuel distribution line are insertable.

3. The clamping arrangement of claim 2, wherein at least one of the first step ring and the second step ring is held in the coaxial holes by a smaller-diameter shoulder of the connection piece of the fuel distribution line.

4. The clamping arrangement of claim 1, wherein the first step ring and the second step ring are held concentrically with respect to each other by a shoulder of one of the first step ring and the second step ring, the shoulder engaging with a corresponding step of an axial hole of the other step ring.

5. The clamping arrangement of claim 1, wherein the first step ring and the second step ring are held concentrically relative to one another by a sleeve situated in a common axial hole of the first step ring and the second step ring.

6. The clamping arrangement of claim 1, further comprising a tensioning device, wherein each of the first step ring and the second step ring includes a tensioning element on its circumference, the tensioning device is provided between the tensioning elements of the first step ring and the second step ring, the first step ring and the second step ring being axially pressed apart if the tensioning elements are pulled toward one another.

7. The clamping arrangement of claim 6, wherein each of the tensioning elements includes a bolt rotationally mounted so that an axis of the bolt is parallel to an axis of a corresponding step ring, each of the bolts being axially movable and penetrated by a transverse hole.

8. The clamping arrangement of claim 7, wherein the transverse hole of one of the bolts includes a threaded hole, and the tensioning device includes a screw held in the transverse hole of the other bolt and engaging with the threaded hole.

9. The clamping arrangement of claim 8, wherein the tensioning device is positioned on the circumference of the first step ring and the second step ring so that one axis of the screw is approximately perpendicular to a plane defined at least approximately by a rigid fuel distribution line along its longitudinal extension and by the fuel injector connected to it.

10. The clamping arrangement of claim 1, wherein the at least one first circumferential slope surface of the first step ring and the at least one second circumferential slope surface of the second step ring resemble teeth of a saw.

11. A fuel injection system comprising:

a fuel distribution line;

fuel injectors for directly injecting fuel into combustion chambers of an internal combustion engine, the fuel injectors connected to the fuel distribution line via connection nozzles, the fuel injectors insertable into mounting holes of a cylinder head of the internal combustion engine; and clamping elements, each of the clamping elements at least partially surrounding a corresponding fuel injector and including a first step ring at least partially surrounding the corresponding fuel injector and resting on the corresponding fuel injector via a valve pressure surface, the first step ring including at least one first circumferential slope surface on a side of the first step ring facing away from the valve pressure surface and a second step ring including at least one second circumferential slope surface and a counterpressure surface;

wherein the at least one first circumferential slope surface of the first step ring engages with the at least one second circumferential slope surface of the second step ring, and are arranged so that the first step ring and the second step ring are pressed axially apart when rotated relatively to one another.

* * * * *